US005545260A

United States Patent [19]

Gärtner et al.

[11] Patent Number: 5,545,260

[45] Date of Patent: Aug. 13, 1996

[54] PICKLING INSTALLATION AND METHOD FOR OPERATING THIS PICKLING INSTALLATION

[75] Inventors: Horst Gärtner, Düsseldorf; Friedrich Hollmann, Grevenbroich; Rafael Rituper, Ötzingen; Bodo Block, Rösrath, all of Germany

[73] Assignees: SMS Schloemann-Siemag AG, Düsseldorf; Keramchemie GmbH, Siershahn, both of Germany

[21] Appl. No.: 161,838

[22] Filed: Dec. 3, 1993

[30] Foreign Application Priority Data

Dec. 3, 1992 [DE] Germany ..... 42 40 572.6

[51] Int. Cl.[6] ..... C23G 1/02

[52] U.S. Cl. ..... 134/41; 266/113

[58] Field of Search ..... 134/3, 41, 9, 56 R; 266/113, 114; 29/81.08

[56] References Cited

FOREIGN PATENT DOCUMENTS 0881657 8/1987 Germany .

3629894 10/1990 Germany .

0482725 9/1994 Germany .

3227792 9/1988 Japan ..... 134/3

*Primary Examiner*—Scott Kastler

*Attorney, Agent, or Firm*—Anderson Kill Olick & Oshinsky, P.C.

[57] ABSTRACT

A method operating a pickling installation for pickling rolled strips comprises several consecutively disposed pickling basins filled with a pickling agent containing acid, through which the strip 4 is passed. A pickling agent containing acid is injected through injection nozzles disposed at least on the sides of the basin. A flexible adaptation to the respective pickling task with the aim of a reduced pickling time period is made possible if the nozzle injections on the sides are actuated variably. The pickling installation is provided for this purpose on both sides of the plurality of the basins, with injection nozzles above and below the strip traveling plane and upstream or downstream of base slide pads located in the basin.

6 Claims, 4 Drawing Sheets

PICKLING INSTALLATION AND METHOD FOR OPERATING THIS PICKLING INSTALLATION

FIELD OF INVENTION

The present invention deals with pickling installations and more particularly to pickling installation and method for operating the same for pickling rolled strips.

BACKGROUND OF THE INVENTION

Prior to processing further the rolled strip, the surface of the strip must be free of scale. For hot rolled strips, for instance, scale is formed as a so-called secondary scale when passing through the hot rolled strip finishing line on the cooling roller table, as well as also in the reeling installation where the strip is wound into coils or bundles. Depending on the quality of the material, the final thickness of the hot rolled strip and rolling speed, the scale attains different layer thicknesses, as well as a different chemical composition.

Acid pickling units today are predominantly used for removing the scale from steel strips. Such units are designed as shallow pickling installations, replacing previously known deep-pickling installations and comprise several shallow consecutively arranged pickling basins and use 18% preheated hydrochloric acid. The steel strips are pulled or pushed through the basins, wherein the layer of scale dissolves in the acid. The acid itself becomes less concentrated in the course of the pickling process so that a continuous supply of fresh acid is required.

DE-OS 36 29 894 discloses improvement in a shallow pickling installation, of rapid strip heating and media replacement in the boundary phase between the strip shaped rolled material and the treatment fluid, by disposing a specific treatment channel inside of the treatment basin. This channel encloses the strip shaped rolled material and is closed towards the top by a cover or lid. The treatment fluid is injected through nozzle beams disposed at the inlet and the outlet. At the inlet, the injection nozzles are directed in the direction of travel of the strip and directed counter to the direction of the travel of the strip at the outlet area. In order to assist the nozzle beams at the inlet and the outlet, additional side injections of the treatment fluid or the pickling agent can be disposed there also below the hot rolled strip. However, in this pickling installation, an undesirable long time period is required for heating the strip and the treatment fluid is only now uniformly applied to the strip.

The acid is introduced into the last pickling basin. Herein, the surface of the strip is to be subjected to conclusive treatment prior to leaving the pickling installation. The pickling agent is pumped out of the last basin, in counter flow, into the upstream basins so that acid with progressively reduced concentration arrives or is directed into the basins lying further upstream.

For minimizing the pickling time and for an increased throughput through the pickling installation, an adequate content of acid is maintained in the contact area between the strip surface and the pickling solution. Depletion of acid occurs by the pickling process in the contact regions. This depletion must be remedied by continuous replacement or exchange, meaning by circulation in the pickling basin. Injection of the pickling solution through the sidewall of the pickling basin, perpendicularly to the strip travel has been shown to be particularly effective. In a shallow pickler, disclosed, for instance in DE-OS 40 31 234, nozzles are arranged below the liquid level in the treatment basin both above and below of the material to be treated on both longitudinal sides of the basin. The nozzles inject the treatment liquid, in opposite directions, at an angle against the material to be treated. The injected acid causes turbulence in the pickling bath and improves the equalization of the acid concentration in the contact regions. Depending upon the speed of the strip moving through the pickling installation, a targeted influence of the turbulence in the basin can be desirable.

EP-OS 04 82 725 discloses varying turbulence in the basin as a function of the speed of the strip.

It is an object of the present invention however to create a method and an installation for improving the operational mode of a pickling installation of the above type and, in particular, a flexible adaptation to the respective pickling task with the aim of a reduced pickling time.

SUMMARY OF THE INVENTION

This and other objects of the invention which shall become hereafter apparent are achieved by the pickling installations and method for operating the same, in which several consecutive pickling basins filled with a pickling agent containing acid. The strip is moved through the basin and a pickling agent containing acid is injected through injection nozzles disposed at least on the sides of the basin.

The object of the invention is achieved by the invention, wherein injections from the side are actuated in a variable manner and in an advantageous embodiment of the invention, the pickling agent is injected with a randomly preselected quantity for each injection.

Furthermore, it is proposed that the agent temperature and/or the acid concentration and/or that nozzle outlet velocity of the pickling agent are preselectable.

The invention is herein based on the knowledge gained that various measures are possible for reducing the pickling time and which has heretofore remained unutilized. This potential for reducing the pickling time lies in the chemical reaction between the layer of scale and the pickling agent which proceeds with differing velocity, being a function of the material quality, the thickness of the scales layer, the structure of the scale, the iron content in the pickling agent, the acid content and the temperature of the pickling agent.

Optimum turbulence is achieved on the upper and lower face of the strip with a result that a predetermined acid concentration is established in the boundary layer by the inventively selective activation and variable actuation of the injections, preferably from the side into the individual basins with a randomly preselectable quantity of the injected pickling agent.

If the pickling agent is transferred from one basin into another basin according to process-dependent instructions, where the injected quantities of the pickling agent and/or the transfer strategy can preferably be preset and preselected by a process computer, an optimum adaptation of the operational mode of the pickling installation to the respective pickling task can be achieved by the injection of the pickling medium from the side, preferably at several points across the length of the pickling basin, as well as by the strategy for the transfer of the pickling agent from one basin to the other. The conditions resulting from the combination of the quality of the material, the thickness and texture of the scale layer are considered as the pickling task. The invention thus permits the presetting of the pickling line as a function of the pickling task. They enable a flexible adaptation to the respective pickling task and lead to the pickling time being reduced and excessive pickling being avoided.

The actuation members required for this task are made available in the invention in that injection nozzles existing at both sides or the plurality of the basins, above and below the strip travel plane, are disposed upstream or downstream of the base skid blocks or pads located in the basin. The injection nozzles can be advantageously disposed to be alternately offset and/or alternately arranged above or below the strip travel plane across the length of the basin. Herein, it is advisable that double injection from injection nozzles located, one opposite the other, is arranged at least at the outlet of the basin or the plurality of basins. Double injection means that a lower, as well as an upper injection nozzle exists at each side and that the two injections are located in the same plane.

The injection nozzles can be disposed at a spacing of 0 to 2,000 mm in front of or behind the base skid blocks or slide pads. The base skid blocks, disposed transversely to the traveling direction of the strip, support the strip from below and serve for intermixing of the pickling agent, which is further assisted by the discovered arrangement of the injection nozzles to be spaced from the base skid blocks. This is because no dead zones with low concentrations of acid in the treatment fluid occur any longer in the region of the base skid blocks, the bath fluid being rather forcefully mixed and made turbulent also in the area of the base skid blocks.

The double injection nozzles, arranged at least at the outlet of the basin or the plurality of basins, promotes intense turbulence, since the liquid jets, aligned opposite one another, supplement each other in the turbulence in the treatment liquid and take care of a uniform temperature or a temperature compensation. Injection nozzles arranged alternatively to be offset can be present across the length of the basin as an alternative or a supplement to the twin injections.

It is advisable that switching valves be integrated into the piping system of the pump system connected to the basin or to the plurality of basins. The pump system is advantageously connected to the process computer which controls the ON-OFF valves as a function of the pickling task. With the expedient piping system comprising integrated ON-OFF valves, different strategies can be realized for accomplishing the pickling task, for instance, the quantity and concentration or intensity of the pickling agent supplied can be varied.

Additionally, ON-OFF or control valves enable different transfer strategies for transferring the pickling agent from one basin into the other basin. The transfusion among the basins can be performed in the same or in opposite direction to the traveling direction of the strip or as a combination of the same and the opposite directions. The pickling task is to be solved in an optimum manner by the respectively changed strategy. In a preferred enrichment with acid in the same direction as the traveling strip, the acid is introduced into the first basin and transferred respectively at the end of the basin into the following basin.

The presetting of the transfer strategy, including the injection of acid, can also be performed manually based on the accumulated experience. However, it is advisable to use a process computer.

BRIEF DESCRIPTION OF THE DRAWINGS

The invention will be better understood by the Detailed Description of the Preferred Embodiment, with reference to the drawings, of which.

DETAILED DESCRIPTION OF THE PREFERRED EMBODIMENTS

Figure 1:
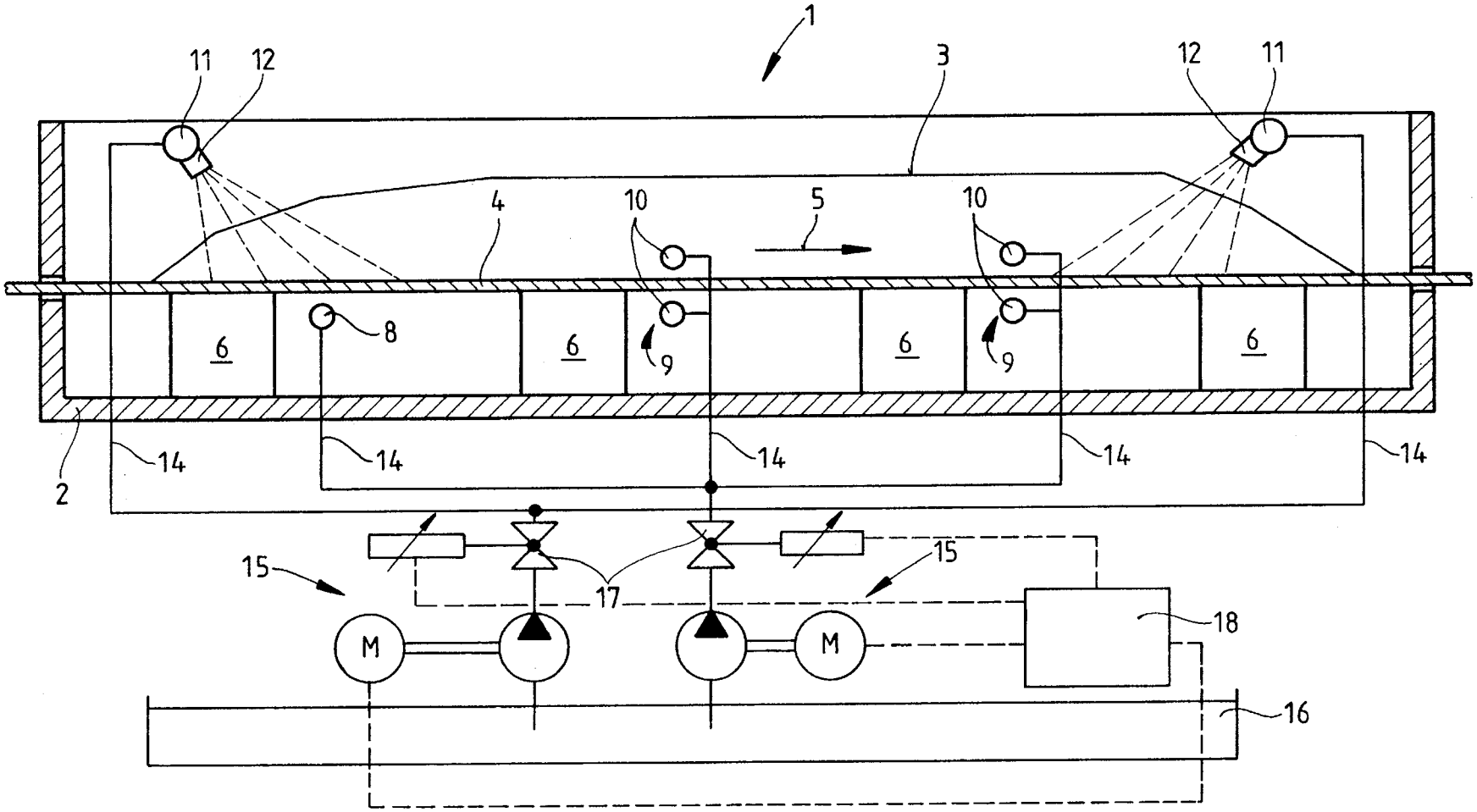
FIG. 1 depicts an embodiment of a pickling installation of the invention, with the inlet side to twin injection nozzles on both sides, shown diagrammatically as an inside view.

Referring now to the drawings, wherein like numerals reflect like elements throughout the embodiments and views, FIG. 1 shows a basin 2 in a pickling installation. Additional basins filled respectively with a pickling agent up to the liquid level 3 can follow basin 2. A strip 4, rolled for instance in a hot rolled strip finishing rolling line, is passed through the basin 2 in direction of the arrow 5 by pulling or pushing. The strip 4 rests upon base skid blocks or slide pads 6 which are spaced from each other transversely to the strip traveling direction on the basin bottom.

Nozzle injections 8, aligned oppositely to each other, are provided beneath the strip 4 in the sidewalls 7 (compare FIG. 3) at the inlet side, meaning the left and of the base 2 in FIG. 1. Towards the outlet side, twin nozzle injections 9 are then disposed. These consists of spray or injection nozzles 10 disposed on both sides of the basin 2, above as well as below the traveling plane of the strip. These injection nozzles inject fresh acid into the liquid bath. Fresh acid is furthermore introduced through supply pipes 11, with distributor nozzles 12 disposed above the liquid level 3, both at the inlet and the outlet. The nozzles 12 are oriented in such a way that the distributor nozzles 23 on the inlet side are directed upon the surface of the strip 4 and the distributor nozzles 12 on the outlet side are directed counter to the traveling directions of the strip.

Figure 2:
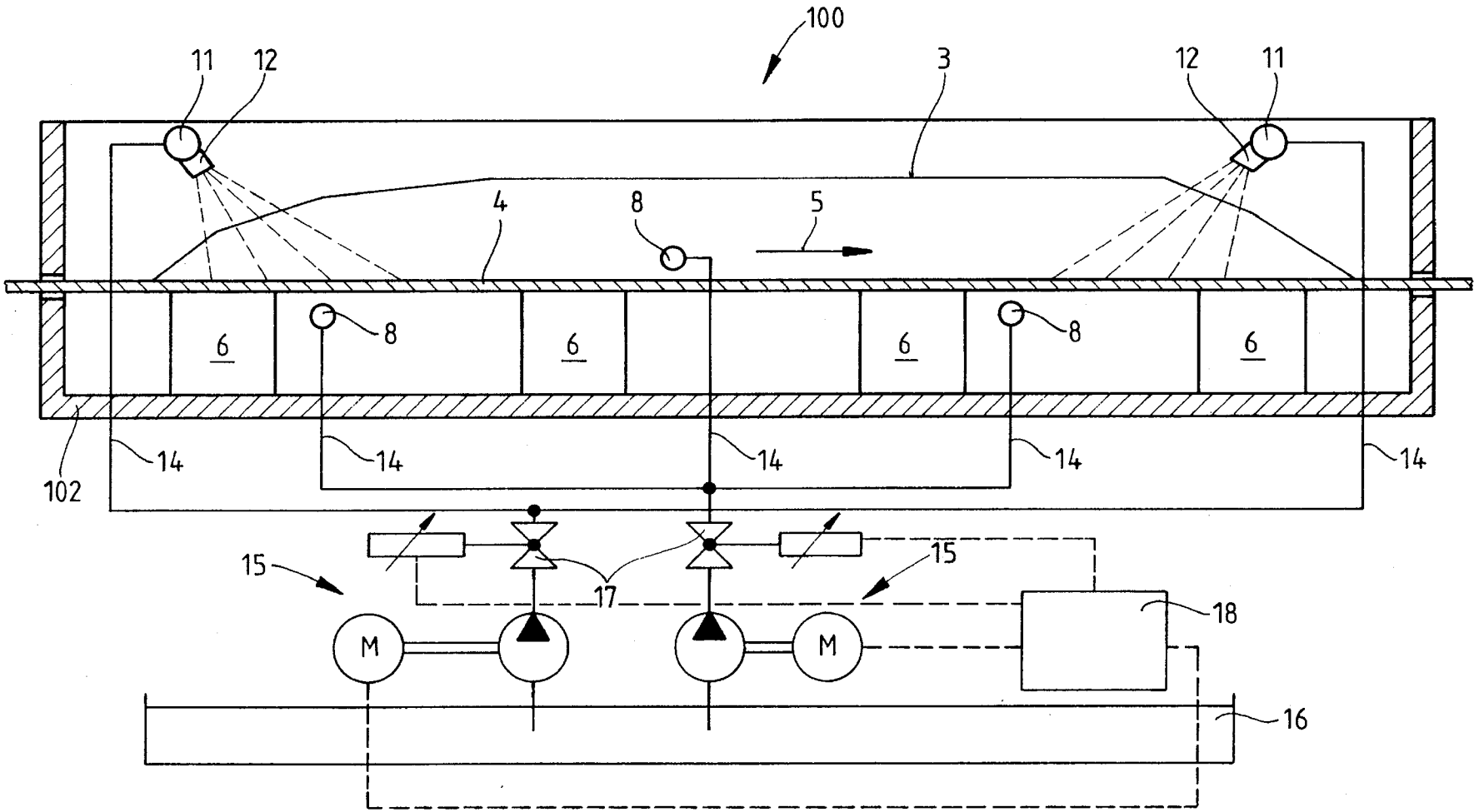
FIG. 2 depicts another embodiment of the invention with nozzle injections arranged alternatively above and below the strip traveling plane, shown diagrammatically as an inside view.
Figure 3:
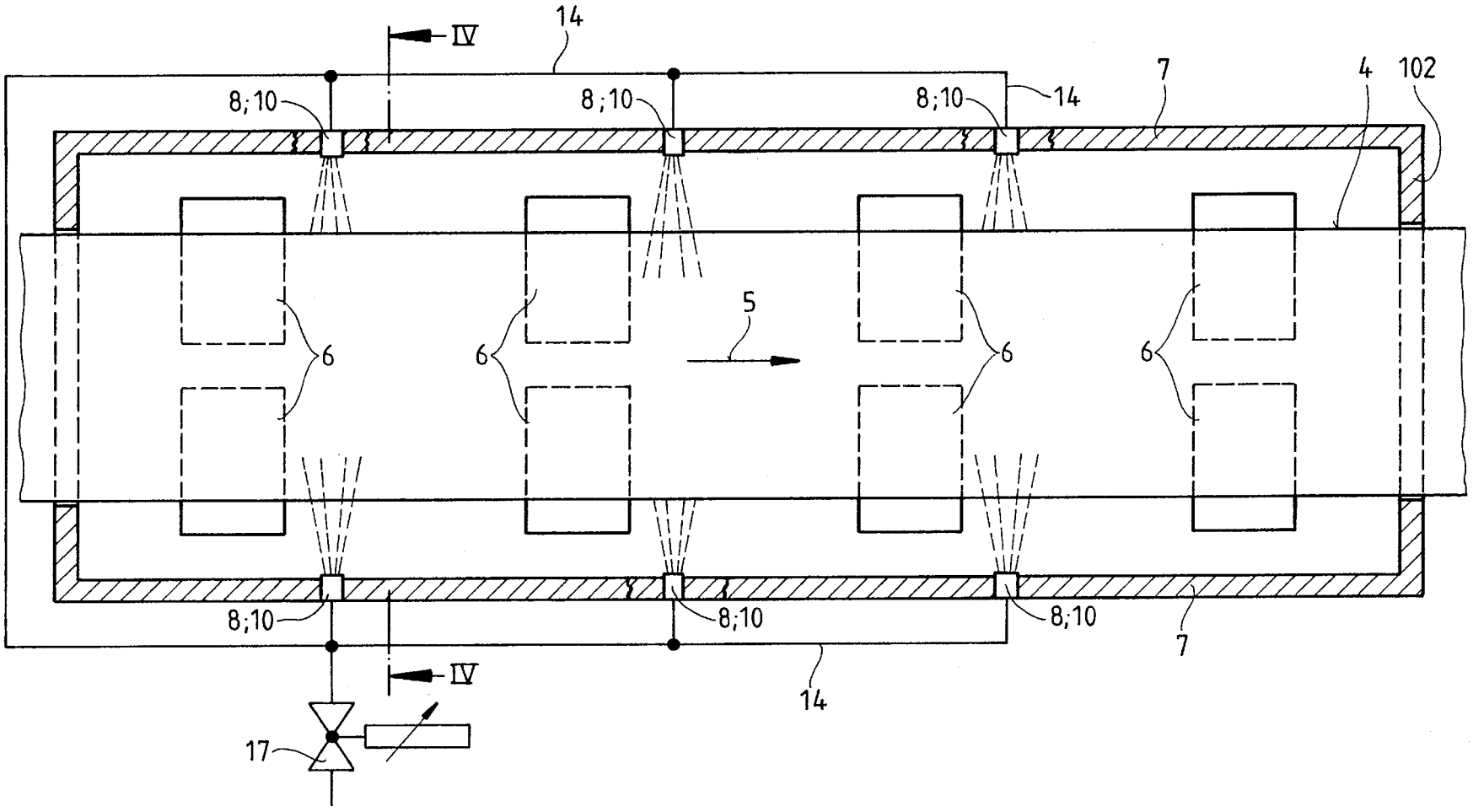
FIG. 3 is a plan view of the basin shown in FIG. 2.
Figure 4:
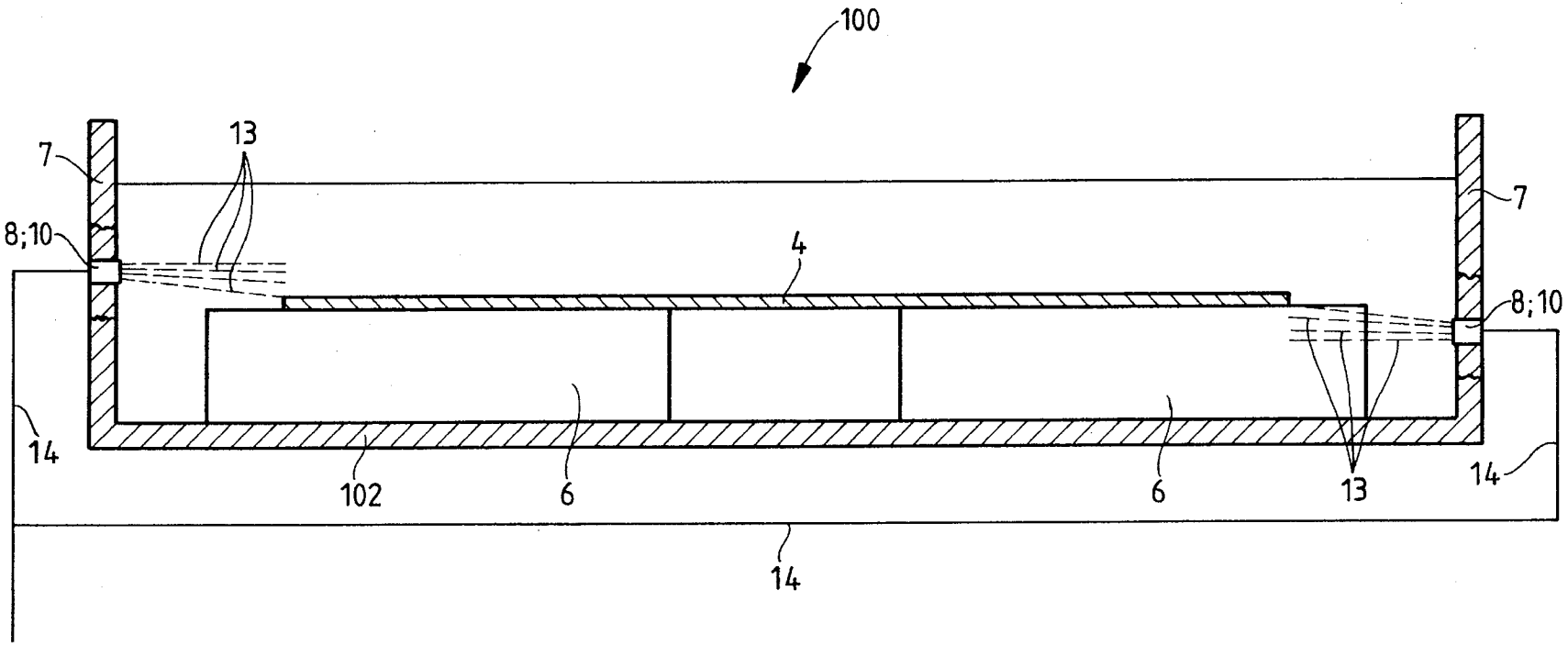
FIG. 4 is a cross-sectioned view through the basin of the pickling installation in FIG. 3, along the line IV–V.

The basin 102 of a pickling installation 100, shown in FIGS. 2–4, differs from the version in FIG. 1 merely by a different arrangement of the injection nozzles 8, so that identical components have been given identical reference numbers. The injection nozzles 8 are disposed alternately above and below the strip 4, without being offset against one another in longitudinal direction, but this could also be a possible variant. As can be seen from FIG. 3, injection nozzle 8 or spray nozzle 10 are in the right hand sidewall 7 in travel direction above, then below (compare the broken lines) and then again above the strip 5 so as to be spaced from the base skid blocks 6. The arrangement is correspondingly reversed in the left side wall 7 of the basin 102, meaning injection nozzle 8 or a spray nozzle 10, etc., disposed at the top, follows upon one disposed at the bottom and then again upon one disposed at the bottom. The fresh acid is injected approximately parallel to the strip 4 (compare the jets 13 in FIG. 4), which favors a good turbulence or vorticity in the pickling agent. As in the Figures, the injection nozzles 8 are connected by pipelines 14 with a pump system 15, which feeds fresh acid from the storage tank 16 through pipe lines 14 and spray nozzles 10 or injection nozzles 8, 9 into the bath liquid. On/off valves or control valves integrated into the pipe lines 14, are allocated to the injection nozzles, which permit selective activation of the spray nozzles 10 and variations in the injected quantity of acid. The pumping system 15 is connected to a process computer 18, shown as a black box, as has been outlines in FIGS. 1 and 2 by control lines shown by dashed lines.

The pipe lines 14, comprising the integrated on/off valves 17 and connected through the pumping system 15 to the process computer 18, thus enable the selective activation of the spray or inspection nozzles 10. By means of additional on-off valves disposed in the pipe lines connecting the individual basins with one another, the transfer of the pickling agent from one basin into the other basin, in accordance with different strategies is also feasible. The strategies depend upon whether the transfer in between the basins occurs in the same direction as the travel direction 5 of the strip 4, in opposite direction, or as a combination of both. The presetting of the pickling installation 1, 100 to the desired transfer strategy, as well as to the pickling task to be fulfilled, assure a constant overall level of the acid concentration in the individual basins across the total length of the pickling installation 1, 100 adapted to the respective requirements. It also reduces the depletion of the acid concentration in the boundary layer between the surfaces of the strip 4 and the pickling agent, as well as in the dead zones in the area of in particular the base skid stone or slide pads.

While the preferred embodiments of the invention have been depicted in detail, modifications and adaptations may be made thereto, without departing from the spirit and scope of the invention, as delineated in the following claims:

What is claimed is:

1. A method of operating a pickling installation for pickling rolled strips, comprising the steps of:

providing several consecutively arranged basins filled with pickling agent containing acid;

passing said strip through said basins;

providing injection nozzles at, at least, side of said basin;

injecting a pickling agent containing acid through said injection nozzles; and variably actuating said injection nozzles for varying a quantity of the pickling agent and a nozzle exit velocity of the pickling agent, in order to achieve an optimum swirling on upper and lower sides of a strip to be pickled.

2. The method of claim 1, wherein said pickling agent is injected at a random quantity per individual injection.

3. The method of claim 2, wherein one or more of acid concentration, temperature of the agent and nozzle injection velocity of the pickling agent are preselectable.

4. The method of claim 3, wherein the pickling agent is transferrable from one of said basins to another of said basins in accordance with process-dependent presettable instructions.

5. The method of claim 4, wherein said pickling agent is transferred at at least one of the same direction or counter to the direction of travel of the strip.

6. The method of claim 5, wherein at least one of the injected quantities of the pickling agent and a transfer strategy are preset and preselected by computer.

* * * * *